US005845419A

United States Patent [19]

Begg

[11] Patent Number: 5,845,419

[45] Date of Patent: Dec. 8, 1998

[54] SPRING OVERSHOE

[76] Inventor: John Begg, 246 E. 199th St., 1K, Bronx, N.Y. 10458-2650

[21] Appl. No.: 936,092

[22] Filed: Sep. 23, 1997

[51] Int. Cl.[6] ..... A43B 3/10; A43B 21/32

[52] U.S. Cl. ..... 36/7.8; 36/27

[58] Field of Search ..... 36/27, 7.8, 37

[56] References Cited

U.S. PATENT DOCUMENTS

| | | | |
|---|---|---|---|
| 337,146 | 3/1886 | Gluecksmann | 36/7.8 |
| 2,968,105 | 1/1961 | Rizzo | 36/7.8 |
| 4,196,903 | 4/1980 | Illustrato | 272/114 |
| 4,912,859 | 4/1990 | Ritts | 36/7.8 |
| 5,042,175 | 8/1991 | Ronen et al. | 36/28 |
| 5,343,637 | 9/1994 | Schindler | 36/7.8 X |
| 5,435,079 | 7/1995 | Gallegos | 36/38 |

FOREIGN PATENT DOCUMENTS

| | | | |
|---|---|---|---|
| 466770 | 1/1969 | Switzerland | 36/7.8 |

*Primary Examiner*—B. Dayoan

*Attorney, Agent, or Firm*—Richard L. Miller, P.E.

[57] ABSTRACT

A spring shoe that includes a foot engaging portion, an upper platform, an intermediate platform, a first specifically configured spring, a lower platform, and a second specifically configured spring. The foot engaging portion engages the foot of the user. The upper platform is attached to the foot engaging portion. The intermediate platform is spaced vertically below the upper platform and is attached thereto by the first specifically configured spring. The lower platform is spaced vertically below the intermediate platform and is attached thereto by the second specifically configured spring. Each of the first and second specifically configured springs are a one-piece continuous wire formed into a pair of spaced-apart conically-shaped helical coils connected to each other by an integrally formed torsion bar.

14 Claims, 1 Drawing Sheet

SPRING OVERSHOE

BACKGROUND OF THE INVENTION

1. Field of the Invention

The present invention relates to a shoe. More particularly, the present invention relates to a spring shoe.

2. Description of the Prior Art

Numerous innovations for spring shoes have been provided in the prior art that will be described. Even though these innovations may be suitable for the specific individual purposes to which they address, however, they differ from the present invention.

FOR EXAMPLE, U.S. Pat. No. 4,196,903 to Illustrato teaches a pair of appliances, one of which is attachable under each foot of a person, so that the wearer can bounce vertically while walking or jogging. Each appliance includes a pair of vertically spaced apart platforms shaped like a foot, a plurality of compression coil springs between the platforms, and an adjustable toe strap and heel strap secured to the top platform for securement to the foot.

ANOTHER EXAMPLE, U.S. Pat. No. 4,912,859 to Ritts teaches a spring shoe which includes a top plate that holds a person's foot and a bottom plate coupled to the top plate through springs to allow for vigorous jumping. The too plate is stabilized against unwanted motion in a simple and rugged mechanism. An elongated cross bar is provided which has a front end hinged to the front of the top plate and a rear end hinged to the rear of the bottom plate. The cross bar permits vertical motion and pitch of the top plate with respect to the bottom plate, while avoiding other unwanted motions of the top plate such as longitudinal and lateral shifting and tilting in roll.

STILL ANOTHER EXAMPLE, U.S. Pat. No. 5,042,175 to Ronen et al. teaches a user-specific shoe sole coil spring system that is provided as a customized layout of individual coil springs which are seated in a shoe sole having prefabricated circular depressions on its surface. The coil spring system layout and stiffness characteristics may be customized to serve the needs of different users and different applications. A user's weight and particular comfort and/or orthopedic requirements are met in a given shoe size by fitting it with a greater or lesser quantity of springs with different levels of stiffness, or the layout may be a combination of levels. The result is a shock absorption distribution pattern and energy return system for the shoe sole to suit the requirements of a particular application. The sole has a cover strip overlaying the coil spring system which is openable and reclosable for allowing changes in the layout as required, or an entire sole may be replaced as a unit.

FINALLY, YET ANOTHER EXAMPLE, U.S. Pat. No. 5,435,079 to Gallegos et al teaches an athletic shoe that includes a spring interposed in its sole providing superior shock absorbance and energy return. The coil spring increases in diameter and is fixed between two spacers, wherein the spacer adjacent the largest diameter end of the spring delimits a space therein. During compression, the smaller end of the spring passes through the larger end and into the space defined by the spacer. The structure maximizes energy return and prevents bottoming out during compression. In an alternate construction, the sole having the spring is removable from the shoe portion such that the shoe portion can be fixed to a plurality of soles. The arrangement can be further revised to accommodate a hoofed foot of an animal. The spring can also be concealed in a hollow heel member of a dress shoe.

It is apparent that numerous innovations for spring shoes have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a spring shoe that avoids the disadvantages of the prior art.

ANOTHER OBJECT of the present invention is to provide a spring shoe that is simple and inexpensive to manufacture.

STILL ANOTHER OBJECT of the present invention is to provide a spring shoe that is simple to use.

BRIEFLY STATED, YET ANOTHER OBJECT of the present invention is to provide a spring shoe that includes a foot engaging portion, an upper platform, an intermediate platform, a first specifically configured spring, a lower platform, and a second specifically configured spring. The foot engaging portion engages the foot of the user. The upper platform is attached to the foot engaging portion. The intermediate platform is spaced vertically below the upper platform and is attached thereto by the first specifically configured spring. The lower platform is spaced vertically below the intermediate platform and is attached thereto by the second specifically configured spring. Each of the first and second specifically configured springs are a one-piece continuous wire formed into a pair of spaced-apart conically-shaped helical coils connected to each other by an integrally formed torsion bar.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

First Embodiment

Figure 1:
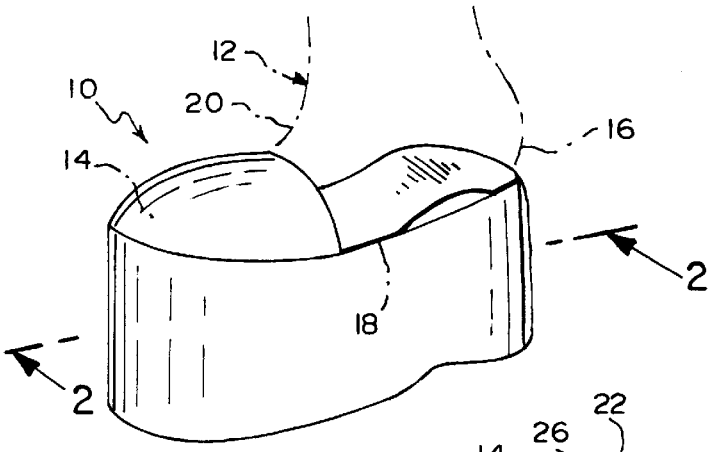
FIG. 1 is a diagrammatic perspective view of a first embodiment of the present invention.

10 spring shoe of the present invention
12 foot
14 toes of foot 12
16 heel of foot 12

18 sole of foot 12
20 vamp of foot 12
22 foot engaging portion
24 inner sole of foot engaging portion 22
26 toe engaging portion of foot engaging portion 22
28 upper platform
30 coil spring
32 intermediate platform
34 first specifically configured spring
36 lower platform
38 outer sole
40 second specifically configured spring
42 flexible shell
44 first helical coil of first specifically configured spring 34
46 widest loop of first helical coil 44 of first specifically configured spring 34
48 disc
50 rivet
52 narrowest loop of first helical coil 44 of first specifically configured spring 34
53 another disc
54 another rivet
56 second helical coil of first specifically configured spring 34
58 torsion bar of first specifically configured spring 34

Second Embodiment

110 spring shoe of the present invention
126 adjustable toe strap
127 adjustable vamp strap
134 first specifically configured spring
140 second specifically configured spring

DETAILED DESCRIPTION OF THE PREFERRED EMBODIMENT

Referring now to the figures in which like numerals indicate like parts, and particularly to FIG. 1, the first embodiment of the spring shoe of the present invention is shown generally at 10 worn on a foot 12 with toes 14, a heel 16, a sole 18, and a vamp 20.

Figure 2:
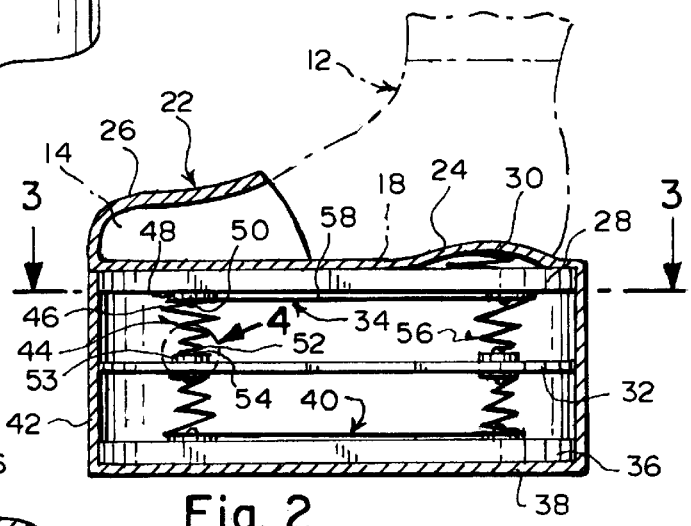
FIG. 2 is an enlarged cross sectional view taken on line 2—2 in FIG. 1.
Figure 3:
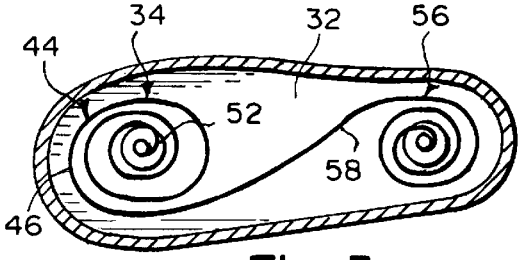
FIG. 3 is a cross sectional view taken on line 3—3 in FIG. 2.
Figure 4:
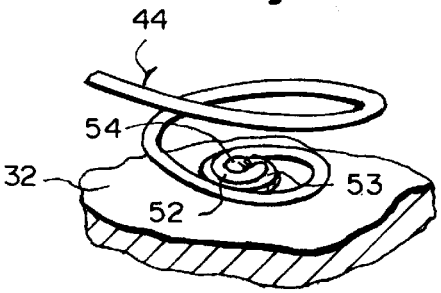
FIG. 4 is an enlarged diagrammatic perspective view of the area generally enclosed in the dotted circle identified by arrow 4 in FIG. 3.

The configuration of the spring shoe 10 can best be seen in FIGS. 2–4, and as such will be discussed with reference thereto.

The spring shoe 10 includes a foot engaging portion 22, which resembles a slipper, for engaging the foot 12. The foot engaging portion 22 has an inner sole 24 for underlying the sole 18 of the foot 12 and a toe engaging portion 26 attached to the inner sole 24 of the foot engaging portion 22 for engaging the toes 14 of the foot 12 so as to allow the spring shoe 10 to be replaceably attached to the foot 12.

The spring shoe 10 further includes an upper platform 28 that has a periphery and is attached vertically below, and to, the inner sole 24 of the foot engaging portion 22, and substantially matches its configuration, and with a coil spring 30 disposed therebetween, under the heel 16 of the foot 12.

The spring shoe 10 further includes an intermediate platform 32 that is spaced vertically below the upper platform 28 and substantially matches its configuration, and is attached thereto, by a first specifically configured spring 34, whose configuration will be discussed further infra.

The spring shoe further includes a lower platform 36 that functions as an outer sole 38 and has a periphery and is spaced vertically below the intermediate platform 32. The lower platform 36 substantially matches the configuration of the intermediate platform 32, and is attached thereto, by a second specifically configured spring 40, whose configuration will be discussed further infra.

The spring shoe 10 further includes a flexible shell 42 that depends from the periphery of the upper platform 38 to the periphery of the lower platform 36, with the intermediate platform 32 housed therein.

The first specifically configured spring 34 is a continuous one-piece wire having a thickness and formed into a first helical coil 44 that has loops with diameters. The first helical coil 44 of the first specifically configured spring 34 is vertically-oriented, conically-shaped, downwardly-tapering, and wound in one direction, and whose widest loop 46 is attached to the upper platform 28, under the toes 14 of the foot 12, by a disc 48 and a rivet 50, and whose narrowest loop 52 is attached to the intermediate platform 32, by another disc 53 and another rivet 54.

The diameter of the loops, and the thickness of the continuous wire, of the first helical coil 44 decease from the widest loop 46 to the narrowest loop 52 allowing each loop to comprises into the next largest loop so as to prevent unwanted longitudinal and lateral movement of the first helical coil 44.

The first specifically configured spring 34 is further formed into a second helical coil 56 that is similar to the first helical coil 44, except that it is wound in the opposite direction and is positioned under the heel 16 of the foot 12.

The first specifically configured spring 34 is further formed into a torsion bar 38 that is generally serpentine-shaped and longitudinally-oriented and connects the widest loops 46 of the first helical coil 44 and the second helical coil 56 to each other so as to prevent unwanted twisting of the first specifically configured spring 34.

The second specifically configured spring 40 is similar to the first specifically configured spring 34, with its helical coils being in vertical alignment with the respective helical coils of the first specifically configured spring 34, except that the helical coils are upwardly-tapering.

Figure 5:
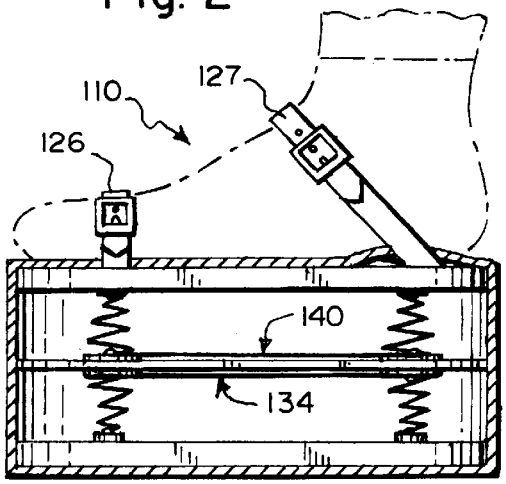
FIG. 5 is an enlarged cross sectional view taken similar to FIG. 2, but of a second embodiment of the present invention.

The configuration of a second embodiment of the spring shoe 110 can best be seen in FIG. 5, end as such will be discussed with reference thereto.

The spring shoe 110 is similar to the shoe spring 10, except that the toe engaging portion is an adjustable toe strap 126, an adjustable vamp strap 127 is added for engaging the vamp 20 of the foot 12, and the second specifically configured spring 140 and the first specifically configured spring 134 are reversed with each other.

It will be understood that each of the elements described above, or two or more together, may also find a useful application in other types of constructions differing from the types described above.

While the invention has been illustrated and described as embodied in a spring shoe, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

It is claimed:

1. A spring shoe, comprising:

a) a foot engaging portion for engaging a foot of a user;

b) an upper platform attached to said foot engaging portion;

c) a lower platform spaced vertically below said upper platform; and d) a spring arrangement connecting said upper platform to said lower platform, wherein said foot engaging portion has an inner sole for underlying the sole of the user and a toe engaging portion attached to said inner sole of said foot engaging portion for engaging the toes of the user so as to allow said spring shoe to be replaceably attached to the foot of the user, further comprising a coil spring disposed between said inner sole of said foot engaging portion and said upper platform, under the heel of the user.

2. The shoe as defined in claim 1, wherein said toe engaging portion is an adjustable toe strap, and said foot engaging portion further has an adjustable vamp strap for engaging the vamp of the user.

3. A spring shoe, comprising:

a) a foot engaging portion for engaging a foot of a user;

b) an upper platform attached to said foot engaging portion;

c) a lower platform spaced vertically below said upper platform; and d) a spring arrangement connecting said upper platform to said lower platform, wherein said upper platform has a periphery and substantially matches said inner sole of said foot engaging portion, further comprising an intermediate platform spaced vertically below said upper platform and substantially matches its configuration, and is attached thereto, by a first specifically configured spring of said spring arrangement, wherein said lower platform functions as an outer sole and has a periphery, and is spaced vertically below said intermediate platform, and substantially matches its configuration, and is attached thereto, by a second specifically configured spring of said spring arrangement, wherein each of said first specifically configured spring and said second specifically configured spring of said spring arrangement is a continuous one-piece wire having a thickness and formed into a first helical coil and a second helical coil that have loops with diameters.

4. The shoe as defined in claim 3; further comprising a flexible shell depending from said periphery of said upper platform to said periphery of said lower platform, with said intermediate platform housed therein.

5. The shoe as defined in claim 3, wherein said first helical coil and said second helical of each of said first specifically configured spring and said second specifically configured spring of said spring arrangement are vertically-oriented and conically-shaped.

6. The shoe as defined in claim 5, wherein said first helical coil of said first specifically configured spring of said spring configuration and said first helical coil of said second specifically configured spring of said spring configuration are wound in one direction.

7. The shoe as defined in claim 6, wherein said second helical coil of said first specifically configured spring of said spring configuration and said second helical coil of said second specifically configured spring of said spring configuration are wound in an opposite direction.

8. The shoe as defined in claim 3, wherein said first helical coil and said second helical coil of said first specifically configured spring of said spring arrangement are downwardly-tapering, with a widest loop of said first helical coil of said first specifically configured spring of said spring arrangement being attached to said upper platform, under the toes of the user, by a disc and a rivet, with a narrowest loop of said first helical coil of said first specifically configured spring of said spring arrangement being attached to said intermediate platform, by another disc and another rivet, with a widest loop of said second helical coil of said first specifically configured spring of said spring arrangement being attached to said upper platform, under the heel of the user, by another disc and another rivet, and with a narrowest loop of said second helical coil of said first specifically configured spring of said spring arrangement being attached to said intermediate platform, by another disc and another rivet.

9. The shoe as defined in claim 8, wherein said first helical coil and said second helical coil of said second specifically configured spring of said spring arrangement are upwardly-tapering, with a widest loop of said first helical coil of said second specifically configured spring of said spring arrangement being attached to said lower platform, in vertical alignment with said first helical coil of said first specifically configured spring of said spring arrangement, by a disc and a rivet, with a narrowest loop of said first helical coil of said second specifically configured spring of said spring arrangement being attached to said intermediate platform, by another disc and another rivet, with a widest loop of said second helical coil of said second specifically configured spring of said spring arrangement being attached to said lower platform, in vertical alignment with said second helical coil of the first specifically configured spring of said spring arrangement, by another disc and another rivet, and with a narrowest loop of said second helical coil of said second specifically configured spring of said spring arrangement being attached to said intermediate platform, by another disc and another rivet.

10. The shoe as defined in claim 8, wherein said first specifically configured spring of said spring arrangement is further formed into a torsion bar that is generally serpentine-shaped and longitudinally-oriented and connects said widest loops of said first helical coil and said second helical coil thereof to each other so as to prevent unwanted twisting of said first specifically configured spring of said spring arrangement.

11. The shoe as defined in claim 9, wherein said second specifically configured spring of said spring arrangement is further formed into a torsion bar that is generally serpentine-shaped and longitudinally-oriented and connects said widest loops of said first helical coil and said second helical coil thereof to each other so as to prevent unwanted twisting of said second specifically configured spring of said spring arrangement.

12. The shoe as defined in claim 9, wherein said first helical coil and said second helical coil of said first specifically configured spring of said spring arrangement are upwardly-tapering, with a widest loop of said first helical coil of said first specifically configured spring of said spring arrangement being attached to said intermediate platform, by a disc and a rivet, with a narrowest loop of said first helical coil of said first specifically configured spring of said spring arrangement being attached to said upper platform, under the toes of the user, by another disc and another rivet, with a widest loop of said second helical coil of said first specifically configured spring of said spring arrangement being attached to said intermediate platform, by another disc and another rivet, and with a narrowest loop of said second helical coil of said first specifically configured spring of said spring arrangement being attached to said upper platform, under the heel of the user, by another disc and another rivet.

13. The shoe as defined in claim 12, wherein said first helical coil and said second helical coil of said second specifically configured spring of said spring arrangement are downwardly-tapering, with a widest loop of said first helical coil of said second specifically configured spring of said spring arrangement being attached to said intermediate platform, in vertical alignment with said first helical coil of said first specifically configured spring of said spring arrangement, by a disc and a rivet, with a narrowest loop of said first helical coil of said second specifically configured spring of said spring arrangement being attached to said lower platform, by another disc and another rivet, with a widest loop of said second helical coil of said second specifically configured spring of said spring arrangement being attached to said intermediate platform, in vertical alignment with said second helical coil of the first specifically configured spring of said spring arrangement, by another disc and another rivet, and with a narrowest loop of said second helical coil of said second specifically configured spring of said spring arrangement being attached to said lower platform, by another disc and another rivet.

14. The shoe as defined in claim 3, wherein said diameter of said loops, and said thickness of said continuous wire, of said first helical coil and said second helical coil decease from a widest loop to a narrowest loop allowing each loop to compress into a next largest loop so as to prevent unwanted longitudinal and lateral movement of said first and second helical coils.

* * * * *